US008661995B2

(12) United States Patent
Mack et al.

(10) Patent No.: US 8,661,995 B2
(45) Date of Patent: Mar. 4, 2014

(54) MAGNETIC FABRIC RETAINING DEVICE

(75) Inventors: Charles H. Mack, West Bend, WI (US); Jesse C. Mack, Slinger, WI (US)

(73) Assignee: Midwest Products, Inc., Germantown, WI (US)

( * ) Notice: Subject to any disclaimer, the term of this patent is extended or adjusted under 35 U.S.C. 154(b) by 25 days.

(21) Appl. No.: 13/161,282

(22) Filed: Jun. 15, 2011

(65) Prior Publication Data

US 2011/0239921 A1 Oct. 6, 2011

Related U.S. Application Data

(63) Continuation of application No. 12/217,689, filed on Jul. 8, 2008, now Pat. No. 7,966,957, which is a continuation-in-part of application No. 12/072,775, filed on Feb. 28, 2008, now Pat. No. 7,607,399.

(60) Provisional application No. 60/903,997, filed on Feb. 28, 2007.

(51) Int. Cl.
*D05C 9/04* (2006.01)
*D05B 39/00* (2006.01)

(52) U.S. Cl.
USPC ..... 112/103

(58) Field of Classification Search
USPC ..... 112/103; 38/102.91, 102.2
See application file for complete search history.

(56) References Cited

U.S. PATENT DOCUMENTS

| | | | |
|---|---|---|---|
| 3,664,288 | A | 5/1972 | Von Boden et al. |
| 4,834,006 | A | 5/1989 | Goto |
| 5,138,960 | A | 8/1992 | Inteso |
| 5,353,725 | A | 10/1994 | Sakakibara |
| 5,509,367 | A | 4/1996 | Conley, Jr. |
| 5,842,430 | A | 12/1998 | Mack |
| 5,920,139 | A | 7/1999 | Fujiwara et al. |
| 5,934,210 | A | 8/1999 | Lucchese |
| 5,970,895 | A | 10/1999 | Mack |
| 5,992,339 | A | 11/1999 | Mack |
| 6,240,863 | B1 | 6/2001 | Vickroy et al. |
| 6,336,416 | B1 | 1/2002 | French et al. |
| 6,394,012 | B1 | 5/2002 | French et al. |
| 6,457,428 | B1 | 10/2002 | Vickroy |
| 6,679,190 | B1 | 1/2004 | French et al. |
| 7,194,967 | B2 | 3/2007 | Bowlus |
| 7,255,052 | B2 | 8/2007 | Okazaki |
| 7,357,088 | B1 | 4/2008 | Bowius |

(Continued)

FOREIGN PATENT DOCUMENTS

| | | |
|---|---|---|
| JP | 03-130456 | 6/1991 |
| JP | 11-001860 | 1/1999 |

(Continued)

*Primary Examiner* — Ismael Izaguirre
(74) *Attorney, Agent, or Firm* — Ryan Kromholz & Manion, S.C.

(57) ABSTRACT

A device for use with an embroidery machine to hold an item or material to be embroidered between upper and lower hooping members, with the hooping members being secured to one another by use of a magnetic force, preferably with rare earth magnets, is disclosed. The magnets provide a solid, secure mating arrangement between the upper and lower hooping members as well as providing proper alignment of the hoping members. A ridge may be formed in at least one hooping member to securely retain the item or material to be embroidered. One hooping member has interchangeable arms for attaching the mating hooping members to different brands of embroidery machines.

18 Claims, 10 Drawing Sheets

(56) References Cited

U.S. PATENT DOCUMENTS

| | | | | |
|---|---|---|---|---|
| 7,484,466 | B2 | 2/2009 | Kuki et al. | |
| 7,506,596 | B2 | 3/2009 | Bowlus | |
| 7,607,399 | B2 | 10/2009 | Mack et al. | |
| 2004/0163295 | A1 * | 8/2004 | Fontana et al. | 40/617 |
| 2005/0178031 | A1 | 8/2005 | Fabec | |
| 2006/0272565 | A1 | 12/2006 | Bowlus | |
| 2006/0278148 | A1 | 12/2006 | Lord et al. | |
| 2008/0141915 | A1 | 6/2008 | Bowius | |

FOREIGN PATENT DOCUMENTS

| | | | |
|---|---|---|---|
| JP | 411061627 A | * | 3/1999 |
| JP | 11-181666 | | 7/1999 |
| JP | 2002-078996 | | 7/1999 |
| JP | 2005-146460 | | 6/2005 |
| JP | 2006-052496 | | 2/2006 |

* cited by examiner

MAGNETIC FABRIC RETAINING DEVICE

RELATED APPLICATIONS

This application is a continuation of copending U.S. patent application Ser. No. 12/217,689, filed on 8 Jul. 2008, which is a continuation-in-part of U.S. patent application Ser. No. 12/072,775, filed on 28 Feb. 2008, now U.S. Pat. No. 7,607,399, which claims the benefit of U.S. Provisional Patent Application Ser. No. 60/903,997, filed on 28 Feb. 2007.

BACKGROUND OF THE INVENTION

The present invention relates to the field of embroidery and monogramming and more specifically to a hoop that incorporates magnets to hold and secure a garment, piece of material, or other item to be embroidered.

In the embroidery industry "hoop" or "hoops" are referred to by many different terms, like frame, clamp, hooping device, fabric holding device, fabric retaining device and fabric mounting frame. The definition of each of these terms is intended to apply to all of these terms to give these terms their broadest meaning individually and collectively as they are used interchangeably herein. In an instance where the term or terms have more than one meaning, all meanings will apply.

Various types of hoops and frames for holding an item to be embroidered are commonplace for both home embroidery and commercial embroidery machines. Generally, embroidery hoops comprise upper and lower hoops or clamping members that mate with one another. Clothing is placed between the clamping members, usually with a backing material also placed between the lower member and the item to be embroidered. These types of hoops tightly pinch the material between the vertical sides of the upper and lower hoops. Because of this, the lower hoop member needs to be adjusted for any change in thickness of the item to be hooped, which may not always result in the material being sufficiently taut or tight, potentially resulting in an improperly embroidered piece of material.

The use of standard embroidery hoops becomes more difficult when the item to be embroidered is a heavier or thicker material, such as a winter jacket, work overalls, Carhartt® type jackets, or items made of leather. Properly embroidering such items can be very difficult and time consuming. It is very difficult to figure out what adjustment should be made to the lower hoop or clamping member to securely hold the garment, while not having too tight of an arrangement that the two clamping members cannot properly mate with one another. It often takes multiple tries to get the adjustment correct. Some fabrics, like that of Carhartt® type jackets, are not made to be stretched or formed in a manner needed to allow standard hoops to be applied to the fabric, which requires application of a great deal of pressure to try to make the fabric conform to the shape of the hoop.

U.S. Pat. No. 6,336,416 illustrates a clamp style prior art type of hoop or frame that was designed to overcome some of these obstacles. This type of frame does not need to pinch the fabric between vertical edges on its body, so this frame can hold various thicknesses of fabric much easier. It pinches the material between the faces of its upper clamping member and lower clamping member. These clamping members are spring loaded to allow for different thickness of material to be held without adjustment, but they do have limitations. One of the main limitations of the prior art is how far from an edge of a garment that it can hold a portion of fabric to be embroidered. This is because the device requires a pivot point to properly operate. The arrangement makes placing a logo in the middle of the back of a jacket, or on the left or right chest of a garment very difficult. If the distance to the logo location is larger than the distance from the clamping members to the pivot point, the material will need to be gathered in the pivot point to reach the embroidery location, which is usually impossible or impractical for these types of hooping machines.

Other problems arise when using computerized embroidery machines, since the position and orientation of the embroidery on the item is a function of how the item is captured within the hoop. Items to be embroidered are usually placed directly within the clamps while they are mounted on the embroidery machine, as it is difficult and time consuming to remove and reinstall the clamps onto the machine. This creates extra downtime for the machine, since it is not possible to have the next set of items hooped and ready to load onto the embroidery machine. The finished items have to be removed from the clamps and the next items have to be placed in the clamps, while the machine is waiting. The added downtime becomes more evident on machines with multiple heads. Mounting the fabric in the clamps while they are attached to the machine also makes aligning the exact portion of the garment to be embroidered very difficult. Even if the clamp were removed from the machine, there are no commercially available hooping devices or jigs to help align the clamp with a particular portion of a garment. Because of the need for a pivot point and at least one spring for biasing the base plate and upper clamping member in closed contact, the maximum sewing area of the embroidery machine is further limited by this prior art space requirement.

Prior art clamps are typically made out of steel to make them rigid enough to perform their intended operation. Such rigid material, and the extra mechanism needed for the pivot point and spring bias, makes the clamps heavier than standard hoops, with the added weight applying unnecessary stress to the mechanical and electrical components of the embroidery machine. The physical size of the clamp can also cause damage to some embroidery machines if the entire body of the clamp cannot fit under the needle bars used for embroidery. Operators need to be careful not to move the machine to a position that the body of the clamp can contact the needle bars.

U.S. Pat. Nos. 6,240,863 and 6,394,012 illustrate an alternative hoop or frame, created to address the limitations of standard upper and lower hoop members. These frames are designed to hold a special type of sticky backing material. The garment is then placed over and adhered to the sticky material to hold it in place while the embroidery operation is performed. This type of frame is very good for getting into small areas like pockets on garments, or for sewing on delicate fabrics, but is not really designed for everyday normal hooping of garments; it is more for specialty items. One disadvantage to these frames is the need for special sticky backing, which is generally more expensive than standard backing and can leave a residue on the needles of the embroidery machine over time. The residue can cause increased thread breaks and other problems. Also, the backing material has a limited number of uses before it needs to be removed from the frame and a new piece applied, which can increase the production time needed to complete a job. The sticky backing is not strong enough to adequately hold heavy items like Carhartt® type jackets during the embroidery process. The extra expense and increase in production time that is created by the use of sticky backing makes the sticky backing type of frame impractical for most normal placements of designs on shirts and jackets.

U.S. Pat. No. 5,138,960 discloses a magnetic monogramming frame. This frame is designed to be mounted to the pantograph of an embroidery machine from its lower member. The pantograph of the machine is the part that holds and moves the embroidery hoop under the stationary needle to create the design. Mounting a hoop directly to the pantograph requires that you physically fasten the hoop to the pantograph or that you fasten a separate adapter directly to the pantograph. Newer style machines use a set of arms that extend out from the pantograph and have adaptors on the ends of the arms that allow for quicker and easier mounting of hoops. The hoop from this prior art device is not designed to be releasably mounted to the existing hoop holding arms on these newer style commercial embroidery machines. This outdated design increases the time it takes to switch from using one type of frame to another. This prior art frame also incorporates continuous magnetic tape type material instead of separately mounted magnets. This type of magnetic material arrangement does not provide any automatic alignment between the upper and lower members of the frame. The frame of this prior art device pinches the material directly between the magnetic materials; it also does not provide a ridge to help hold the material to be embroidered taut and against the needle plate of the embroidery machine. If the material to be embroidered is not held taught and against the needle plate, this causes bouncing of the material during the embroidery process. This bouncing can cause looping of the embroidery thread and an undesirably look of the finished embroidery.

It is also desirous to improve and simplify the hooping process, in general. Hoops used in the commercial market must be suitable for repetitive, quick and accurate processes. That is, the devices must be set-up quickly for each successive embroidered piece of material, which requires that the hoop will sufficiently hold the fabric solidly in place, in a manner that can be accomplished quickly and efficiently. When embroidering, there is generally a backing piece of fabric located below the piece of clothing to be embroidered. Both the backing material and the item to be embroidered should be sufficiently held in place and not be allowed to move during the embroidery process, once properly aligned.

Present hoops leave room for improvement, as noted above. It would be desirable to have a hoop that would not have to be adjusted for different thicknesses of materials and placement of designs would not be limited by the mounting brackets of the hoop, and would not require a great amount of force to apply it to thick materials. It would also be desirable to be able to hold a large area of material to be embroidered without the embroidery hoop or clamping members limiting the potential sewing area of the embroidery machine, or adding an excessive amount of weight that the machine will have to move during the embroidery process. Another improvement would be to have a hoop that was easy to quickly align and apply to different types of garments.

SUMMARY OF THE INVENTION

The present invention provides a hoop used with embroidery machines that is easy to apply to garments and align during the hooping process. The device generally comprises upper and lower clamping members, with the clamping members being secured to one another by use of a magnetic force, preferably with multiple, individually spaced apart rare earth magnets. The magnets provide a solid, secure mating arrangement between the upper and lower clamping members.

The magnets may be arranged in numerous configurations on the members. For example, one of the hooping members could include magnets while the other member would include or be fabricated from metal or there could be magnets on both members. The number of magnets on each member could be altered as well, preferably with the arrangement of the magnets on the members being generally symmetrically placed around the members. The magnets could be arranged so that the lower hoop has all of one pole facing the upper hoop and the upper hoop has the opposite poles facing the lower hoop, or the magnets could alternate on each of the members.

The lower clamping member may also be a shape that would align itself with a hoop holding bracket or device on a hooping board to assist in proper alignment of the hoop with an item to be embroidered. Alignment could also be accomplished in other manners, such as a pin in the hoop holding bracket and a corresponding hole in the lower hoop member, or the opposite arrangement. The lower clamping member could also have pins or another locating means in it to hold it directly to a hooping board without the need for any additional bracket. This is to make it easier to help properly align the clamping members with a piece of material or garment to be embroidered. At least two individual magnets may be attached to each of the clamping members in a pattern that allows the magnet to magnet attraction to help self-align the upper and lower clamping members of the hoop.

The hoop may have a raised area located between the clamping members to assist in gripping the material that is placed between the clamping members. The raised area could be located on either of the clamping members, both of the members, or it could be a separate element that would be inserted between the members. There could also be a non-slip material like rubber or sandpaper adhered to one or both of the mating surfaces to help hold the article to be embroidered.

The embroidery hoop may have a raised rim to help keep the material to be embroidered taut and against the embroidery machine needle plate during the embroidery operation.

The hoop according to the present invention may further include actuatable biasing means that will assist in proper alignment of the clamping members and provide additional safety features for the hoop.

These and other features of the device will become evident with respect to the drawings and the detailed description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
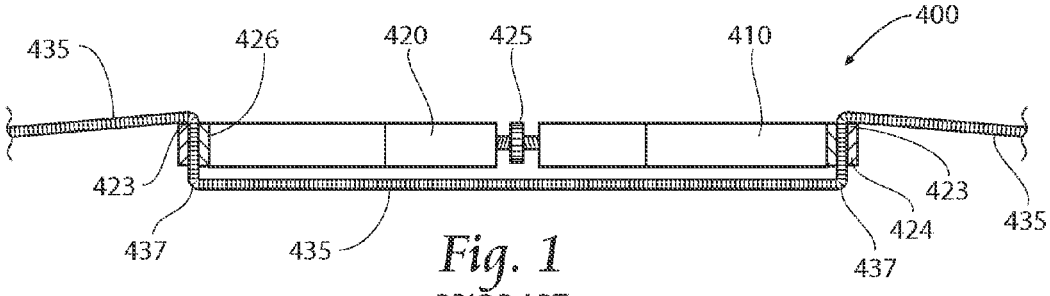
Fig. 1 PRIOR ART
FIG. 1 shows a side view of a prior art embroidery hoop with a piece of material secured between the upper and lower hoops.
Figure 2:
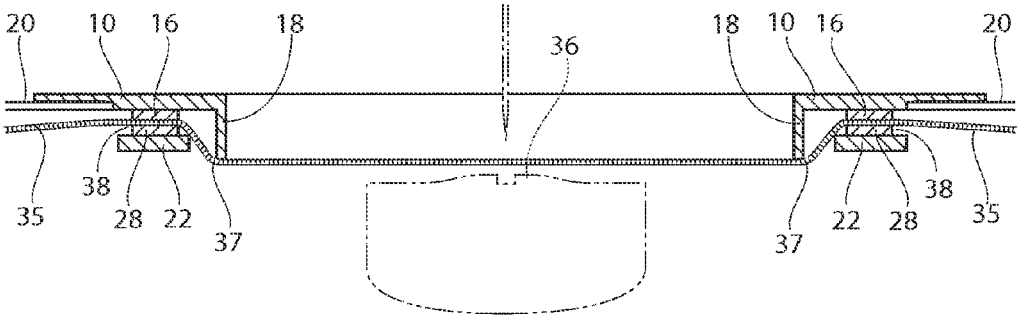
FIG. 2 is a side view of a hooping member according to the present invention with a piece of material secured between the upper and lower clamping members.

The present invention provides a hoop used with embroidery machines that is easy to apply to garments of varying thickness and align during the hooping process. Likewise, alignment can be accomplished quickly and efficiently, regardless of the thickness of the material being placed within the hoop, without distorting the area that embroidery is being placed upon. FIGS. 1 and 2 compare differences in securing material according to the prior art with the present invention. FIG. 1 demonstrates the prior art, while FIG. 2 provides an arrangement according to the present invention.

FIG. 1 shows a side view of a prior art embroidery hoop 400 with a piece of material 435 secured between the upper and lower clamping members 410 and 420. 437 and 423 demonstrate the sharp angle that the standard hoop 400 forms, for which the material 435 must conform so that the male hoop member 410 and female hoop member 420 can hold the material 435. The material 435 is pinched between the inner surface of member 420 shown at 424, and the outer surface of ridge 426 of clamping member 410. Each time the thickness of material 435 is changed, adjustment to the female member 420 needs to be made with adjuster 425 so that the hoop sufficiently retains the material 435. Such an arrangement allows room for error in that the material 435 may not be sufficiently taut for each future use, which can lead to improperly embroidered materials. It is also common for this type of hoop to damage the fabric it is holding, especially with such a severe angle being formed in the material. If the adjustment on the lower hoop is just a little too tight when the two clamping members are pressed together, the fibers of the fabric will be permanently damaged. This is referred to in the industry as "hoop burn."

As shown in FIG. 2, the present invention does not need to form the material into tight bends to hold it. The frame can have a larger gap to allow the material to gradually conform to the shape of the hoop. FIG. 2 shows a side view of upper clamping member 10 and lower clamping member 22 holding a piece of material 35 in place for embroidering purposes. The distance between the mating surfaces 38 of the clamping member 10 and clamping member 22 changes automatically with different thicknesses of items to be hooped or embroidered. Gap 37 is formed from the difference between the outside diameter of ridge 18 and the inside diameter of the lower clamping member 22. Ridge 18 is designed to project the material to be embroidered 35, through and past lower clamping member 22, so that it comes into contact with the needle plate 36 of the embroidery machine. Gap 37 allows the material 35 to gradually change shape between ridge 18 and lower clamping member 22.

Figure 3:
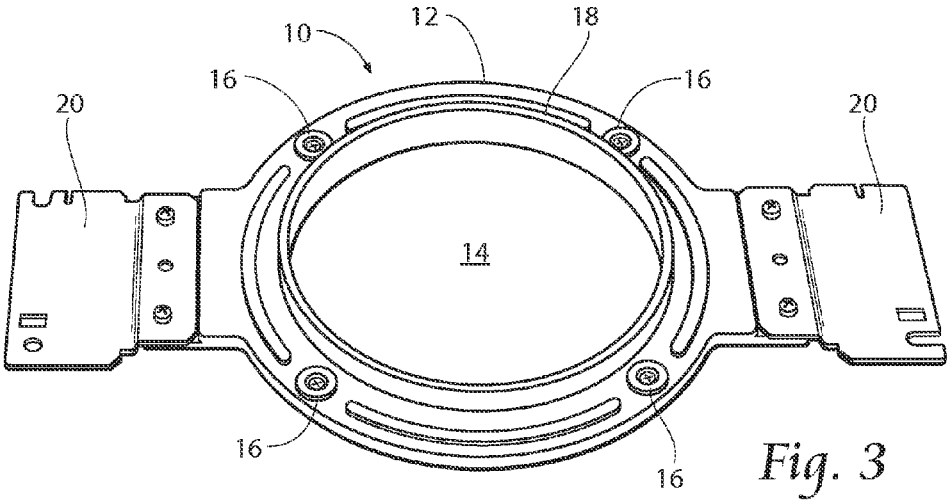
FIG. 3 shows an upper clamping member in accordance with the present invention.

FIG. 3 is a perspective view of the upper clamping member 10 in accordance with the present invention. The clamping member 10 has a generally circular body 12 that forms an opening 14, which provides an area where the material to be embroidered will be situated. The circular body 12 supports a plurality of magnets 16, which are preferably rare earth style magnets. The magnets 16 are preferably symmetrically arranged around the opening 14. The opening 14 is further defined by a ridge 18 which is designed to project the material to be embroidered 35 through and past the lower member 22 (see FIG. 2), so that it comes into contact with the needle plate 36 of the embroidery machine. The upper clamping member 10 can be held in place on an embroidery machine (not shown) by way of oppositely disposed mounting arms 20. The mounting arms 20 can be easily interchanged to fit different models of automated embroidery machines. The ridge 18 can be designed as an integral piece of the clamping member 10.

Figure 4:
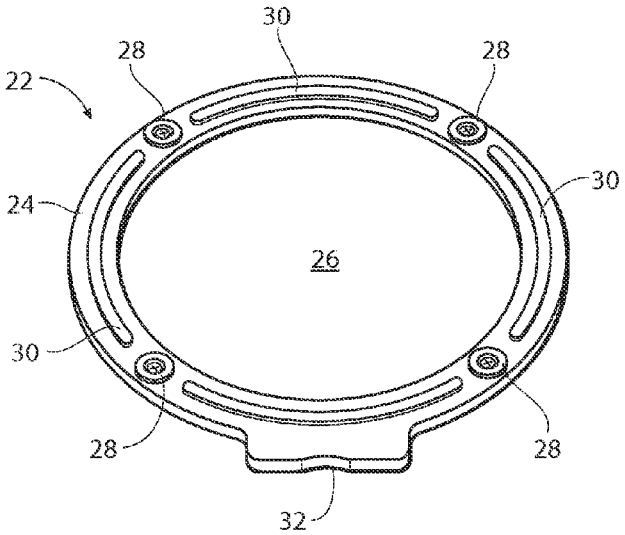
FIG. 4 depicts a lower clamping member arranged to mate with the member of FIG. 3.

Referring to FIG. 4, the lower clamping member 22 is shown, which comprises a generally circular body 24 that forms an opening 26. The opening 26 is designed to mate with the opening 14 of the hoop 10, and is slightly larger than the opening 14. The member 22 also has a plurality of magnets 28, which are designed to mate with the magnets 16 and are of an opposite magnetic pole than a corresponding magnet 16. The member 22 may further have raised areas 30 that further properly secure the material. The member 22 could also have a feature like as shown at 32 that would allow member 22 to easily attach or align itself with a hoop holding bracket or device on a hooping board. This would allow easier and more accurate alignment between the clamping members and the items to be embroidered. This alignment could also be accomplished by another method such as a pin in the hoop holding bracket and a corresponding hole in the lower clamping member, or the opposite (not shown). The clamping member 22 could also have pins or another locating means in it to hold it directly to a hooping board without the need for an additional bracket.

Figure 5:
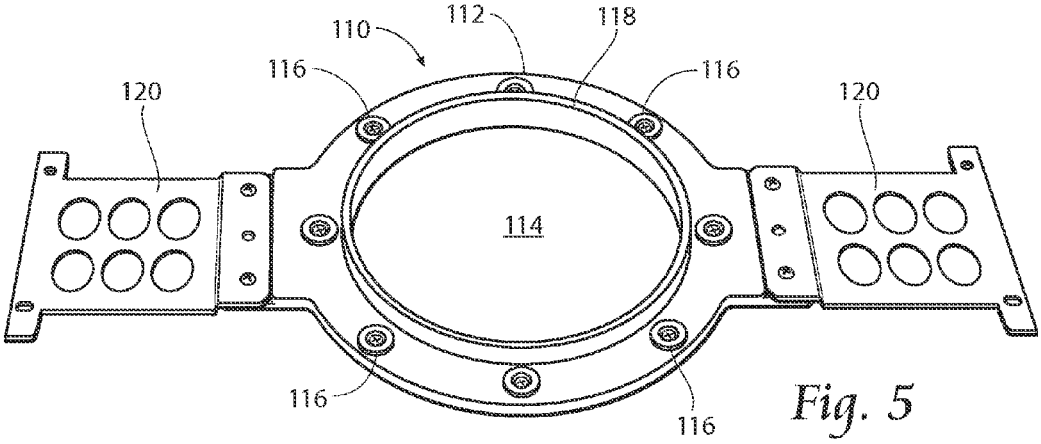
FIG. 5 is a second embodiment of an upper clamping member according to the present invention.

FIG. 5 provides an optional clamping member 110. The clamping member 110 is generally similar to the clamping member 10 (FIG. 3) having a generally circular body 112 that defines an opening 114, which is further defined by a ridge 118 designed to function as ridge 18 in the previous embodiment (see FIG. 3). The body supports a plurality of magnets 116, which are also symmetrically arranged around the opening 114. A pair of opposing arms 120 will secure the member 110 to an embroidery machine. The mounting arms 120 in FIG. 5 are designed for differently arranged embroidery machines than the arms 20 in FIG. 3, but perform the same purpose of securing the clamping member 110 to an embroidery machine. It should be noted that these arms are designed to be easily interchanged to fit different models of automated embroidery machines, and it should be understood that any shape or design of an arm that will allow a hoop to be properly mounted will fall within the scope of the present invention.

Figure 6:
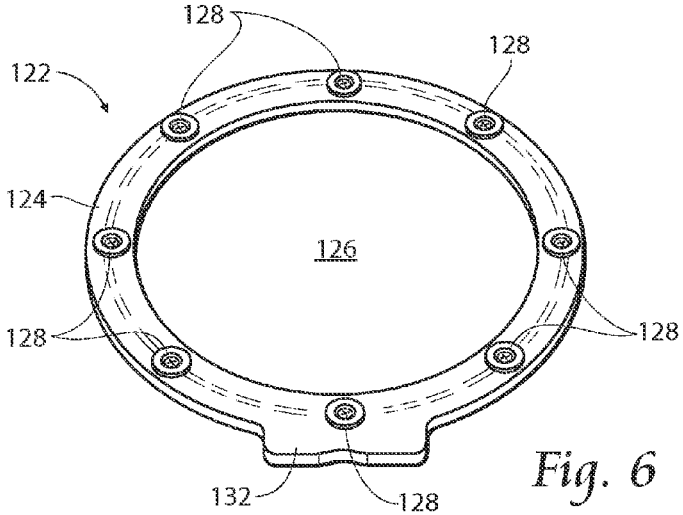
FIG. 6 is a lower clamping member arranged to mate with the clamping member of FIG. 5.

FIG. 6 shows a clamping member 122 arranged to mate with the clamping member 110 of FIG. 5. The member 122 has a generally circular body 124 that forms an opening, which will mate with the member 110 and around the ridge 118. The member 122 has a plurality of magnets 128 that will mate with the magnets 116. The member 122 could also have a feature like as shown at 132 that would allow member 122 to easily attach or align itself with a hoop holding bracket or device on a hooping board. This alignment could also be accomplished by another method such as a pin in the hoop holding bracket and a corresponding hole in the lower clamping member, or the opposite (not shown). The clamping member could also have pins or another locating means in it to hold it directly to a hooping board without the need for an additional bracket.

Figure 7:
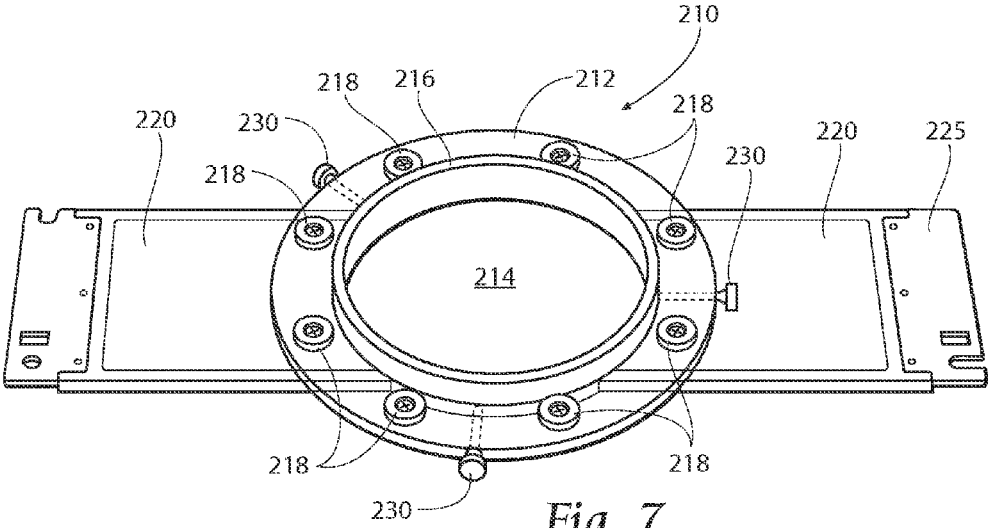
FIG. 7 is another embodiment of an upper clamping member according to the present invention.
Figure 8:
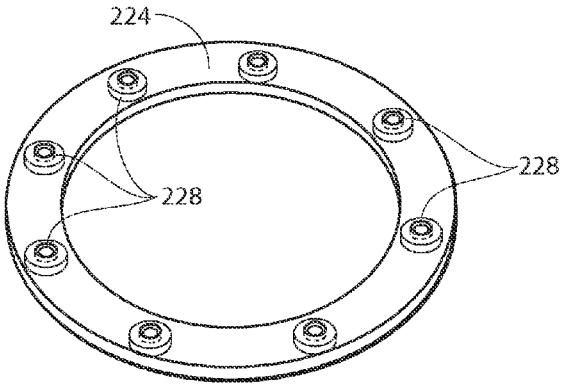
FIGS. 8-10 show lower clamping members arranged to mate with the member of FIG. 7.
Figure 9:
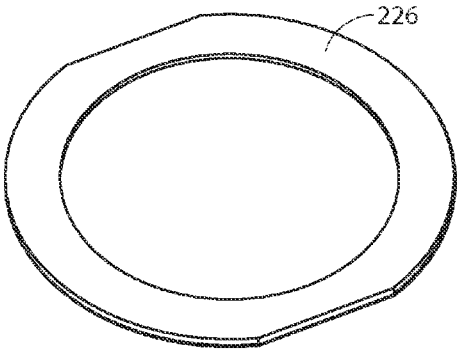
Figure 10:
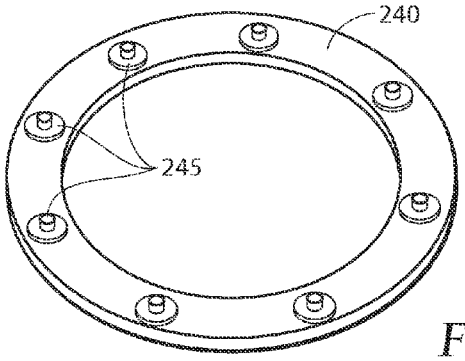
Figure 17:
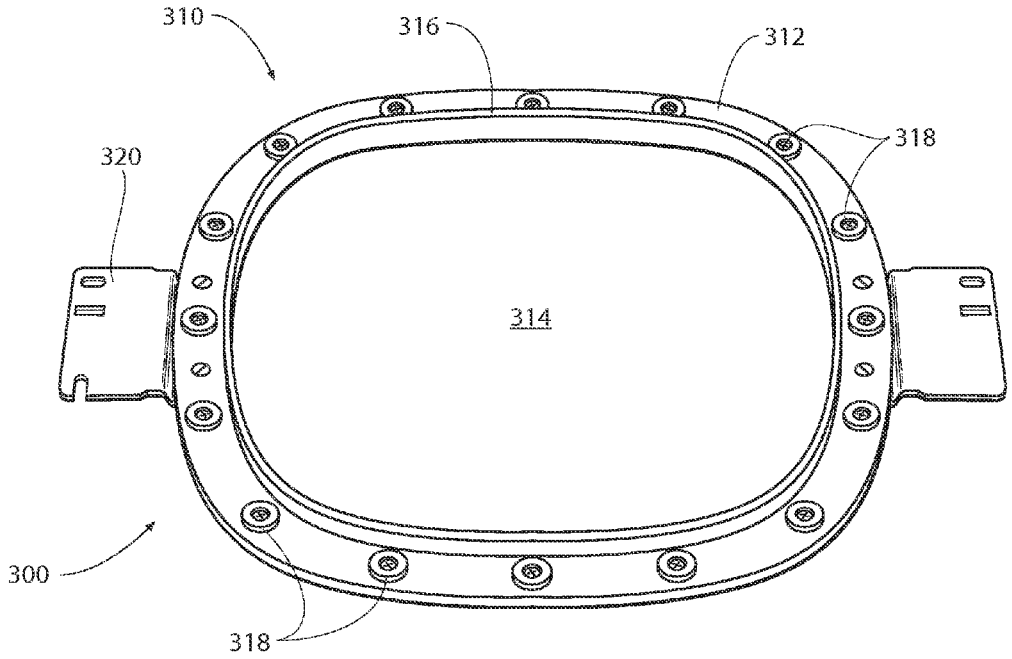
FIG. 17 shows another arrangement for a top clamping member according to the present invention.

FIG. 7 shows a further embodiment 210 of an upper clamping member according to the present invention. As with the previous embodiments, the clamping member 210 has a generally circular body 212. In this embodiment, member 210 is designed to attach to an existing embroidery hoop 220. In this embodiment brackets 225 and ridge 216 are already a part of the existing hoop, so only member 210 has to be manufactured. The body 212 supports a plurality of magnets 218. FIGS. 8 through 10 depict various clamping members that are designed for interaction with any clamping member that includes at least one magnet, including upper clamping members 10 (FIG. 3), 110 (FIG. 5), 210 (FIG. 7), 310 (FIG. 13), or 510 (FIG. 17). A member 210 (FIG. 7) could mate with a lower member 224, which comprises a plurality of magnets 228. A non-slip material like rubber gasket, sandpaper, or the like (not shown) could be adhered to the mating surface of one of clamping members 210 or 224, or both of the mating surfaces to provide added friction when securing pieces of clothing, but it is not necessary. Again referring to FIG. 7, securing means 230, such as a pin, screw or the like, can be used to hold the upper member 210 to the hoop 220, if the member 210 and hoop 220 are designed as separate pieces. Many other means to secure clamping member 210 to hoop 220, could be used. Clamping member 226 (FIG. 9) is yet another alternate member that clamping member 210 could mate with. Member 226 is a lower member completely made of metal or another material that would be sufficiently attracted to magnets 218. Likewise, FIG. 10 demonstrates another lower clamping member 240 that comprises a plurality of metal washers 245 instead of magnets for attraction to the magnets 218. It is understood that each of these embodiments would fall within the scope of the present invention.

FIGS. 11 through 14 provide yet another embodiment 50 of a hoop according to the present invention. Hoop 50 comprises added features to help reduce the cost of producing different sizes of hoops needed for different applications. The hoop 50 comprises a main body 52 with interchangeable attachment arms 62 for mating with different brands of embroidery machines. Body 52 is also adaptable to mate with various sizes and shapes of interchangeable magnetic clamping members 90 and 70.

Figure 11:
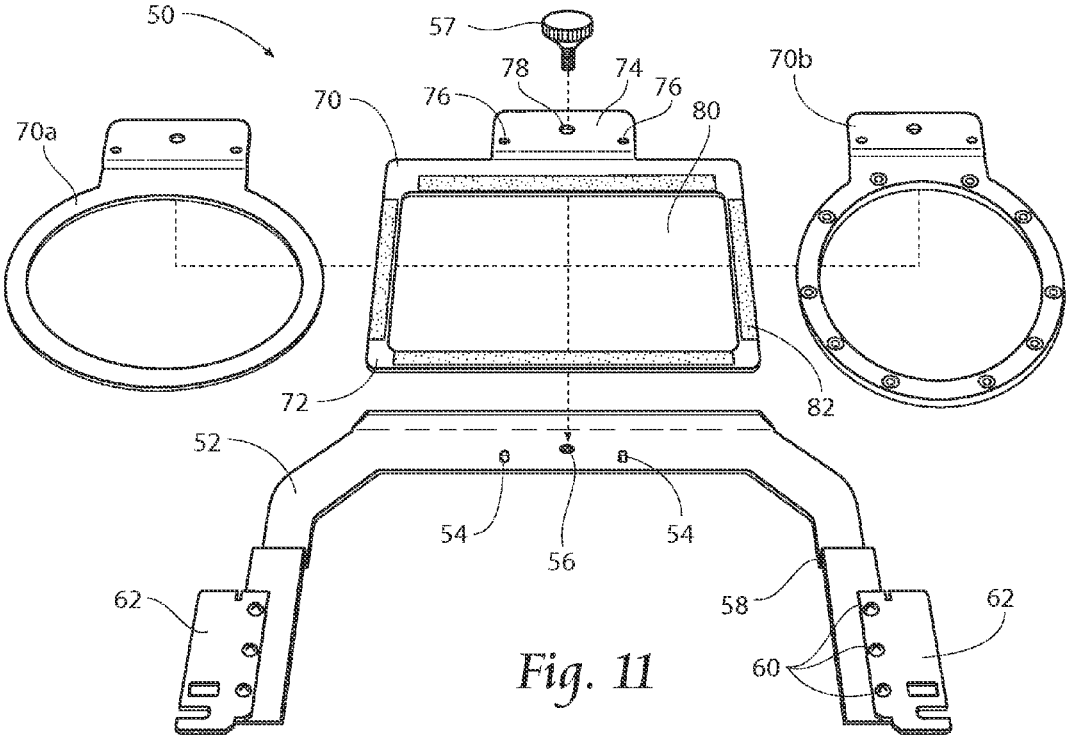
FIG. 11 is a perspective view of another embodiment of the present invention with interchangeable lower clamping members that are designed to be mounted to the main body of the device.

FIG. 11 is a perspective view of the main body 52 with one style of interchangeable attachment arms 62 and three exemplary lower clamping members 70 that can be attached. The body 52 can be held in place on an embroidery machine (not shown) by way of oppositely disposed mounting arms 62. The mounting arms 62 are attached to body 52 by screws 60 or similar fasteners that are easily removed. Mounting arms 62 can be easily interchanged to fit different models of automated embroidery machines. Mounting arms 62 will vary in configuration, shape, and form of mating engagement from one model of embroidery machine to another. This allows the hoop 50 to have one standard body 52 that can be adapted to fit different brands of embroidery machines. The main body 52 may require a step-up portion 58 to allow the lower clamping member 70 to be a little below the level of the mounting arms 62. This is to allow the clamping member 70 to be at the level of the needle plate 36 (see FIG. 2) of the embroidery machine (not shown), while the mounting arms 62 are at the level of the embroidery frame receiving arms on the embroidery machine (not shown).

To provide the mating capability between body 52 and lower clamping member 70, at least one alignment pin 54 and one threaded hole 56, or other type of suitable fastening means, are formed on the upper surface of body 52. Lower clamping member 70 includes an integrally-formed mounting portion 74 and a main body 72. The main body 72 forms an opening 80 that is designed to mate with opening 94 of the upper clamping member and provides an area where the material to be embroidered will be situated. A non-slip material such as a rubber gasket, sandpaper, or the like 82 could be attached to the top surface of body 72 to provide added friction when securing pieces of clothing, but it is not necessary. Holes 76 in mounting portion 74 are made to engage with the pins 54 formed in the upper surface of body 52 to align clamping member 70 with body 52. Hole 78 is formed in the free edge of mounting portion 74 and is designed to mate with hole 56 of the main body. Once holes 76 and 78 are aligned with pins 54 and threaded hole 56, thumb screw 57 is placed through hole 78 and into threaded hole 56. Fastener 57 is then rotated in a conventional manner to place pressure on the mounting portion 74 of clamping member 70, securing clamping member 70 to body 52. When it is necessary to change to a different size or shape clamping member, only thumb screw 57 has to be removed and then the lower clamping member can be removed and replaced with a new size or shape clamping member 70.

Figure 12:
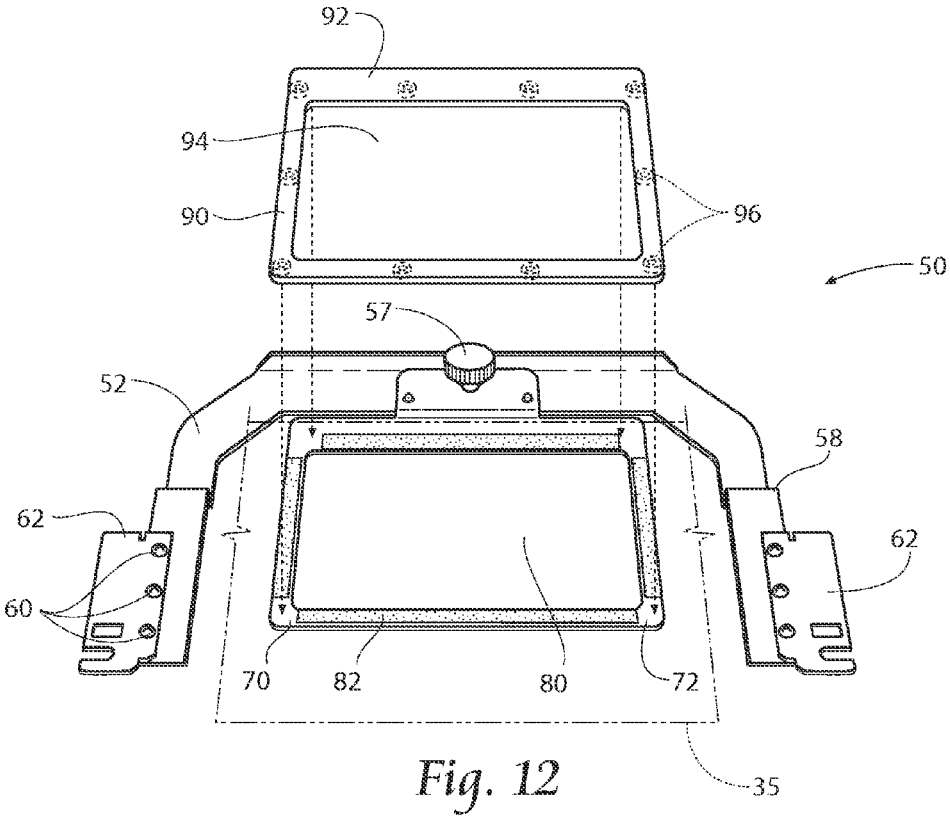
FIGS. 12 to 14 are perspective views similar to FIG. 11 but also show the lower clamping members mounted to the main body and the corresponding upper clamping member prior to mating.

FIG. 12 shows another embodiment of the present invention with a lower clamping member 70 attached to body 52 and its corresponding upper clamping member 90.

Figure 13:
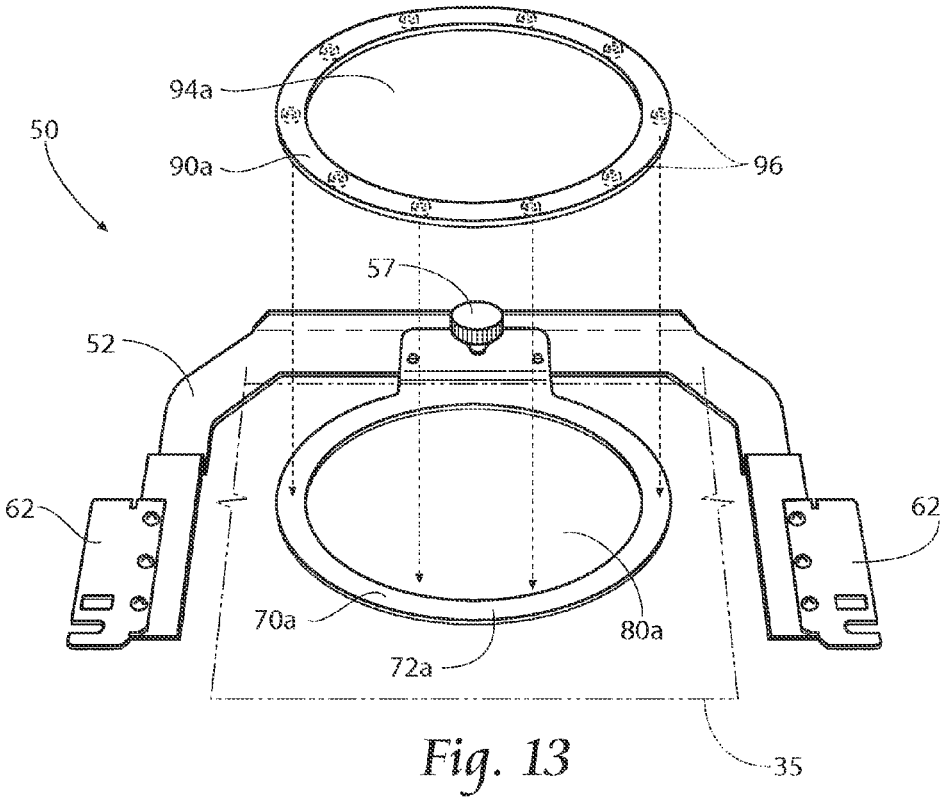

FIG. 13 continues to illustrate, but is not exhaustive, of a different shape and size clamping member 70 that can be mounted to body 52 and its corresponding upper member 90. The lower clamping member 70 in FIGS. 12 and 13 are made of metal, or other material that can be attracted to magnets, for attraction to upper clamping member 90.

As with previous embodiments the body 92 of upper clamping member 90 supports a plurality of magnets 96. The magnets 96 are arranged around the opening 94 in a pattern that would be best suited to hold the type of material or item to be embroidered. Member 90 is relatively the same size and shape as its matching member 70.

Figure 14:
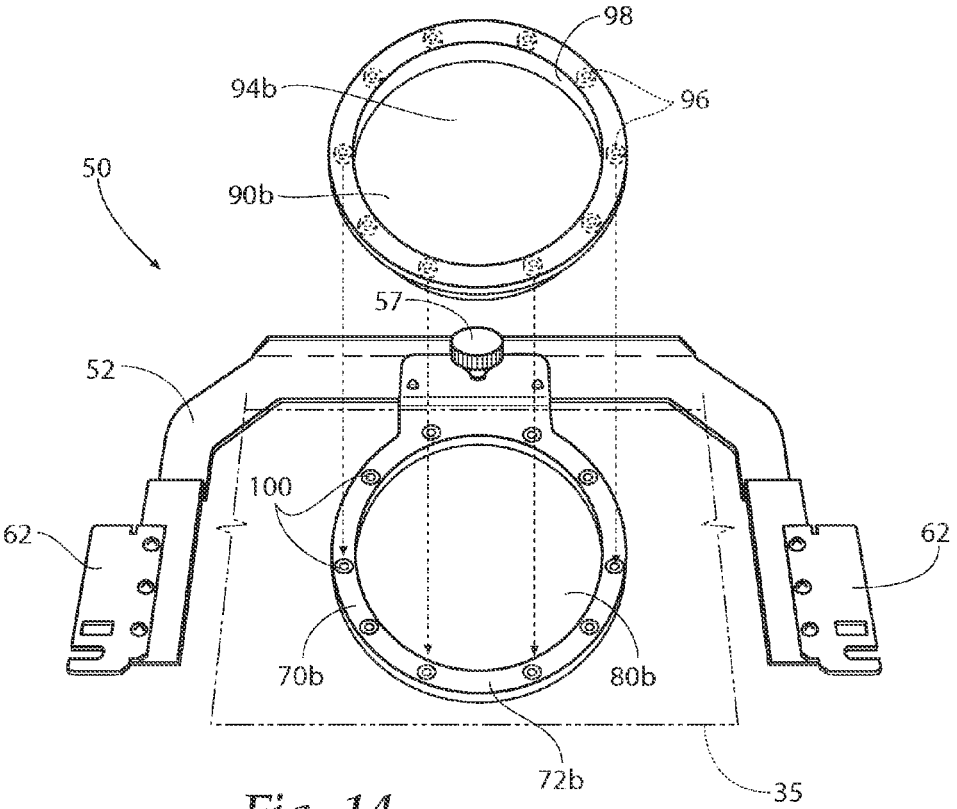

FIG. 14 shows a perspective view of another form of clamping members 70 and 90. In this embodiment, clamping member 70 is very similar to clamping member 70 of FIGS. 12 and 13, but the body 72 supports a plurality of magnets 100 that are arranged to be attracted to corresponding magnets 96 of the upper member 90. Upper clamping member 90 is very similar to member 90 of FIGS. 12 and 13, but opening 94 of this member is further defined by a ridge 98 which is designed to project the material to be embroidered 35 through and past the lower member 70, so that it comes into contact with the needle plate 36 (FIG. 2) of the embroidery machine. On this embodiment the ridge is necessary because the body of the lower clamping member 72 is thicker to support magnets.

Figure 15:
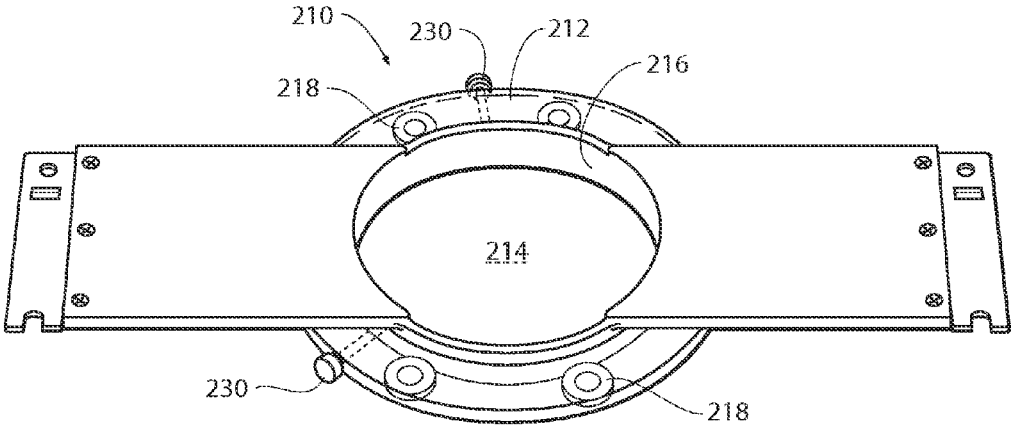
FIGS. 15 and 16 provide perspective views of hooping members according to the present invention, demonstrating the interaction of an upper and lower section.
Figure 16:
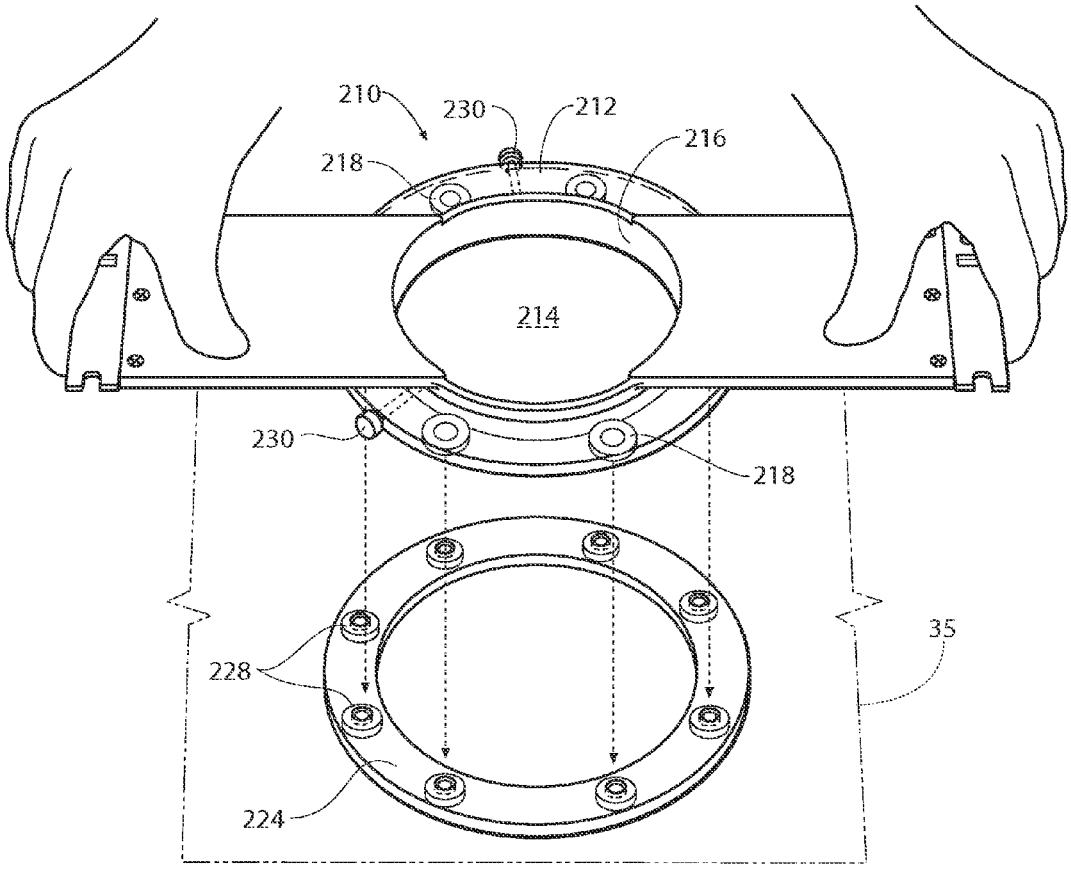

FIGS. 15 and 16 are shown to demonstrate the interaction of the upper clamping member 210 shown in FIG. 7 with the bottom clamping member 224 of FIG. 8. The clamping member 210 is held over the clamping member 224, with the magnets 228 and 218 generally aligned. However, it is not necessary that the magnets 228 and 218 are completely aligned, because the attraction of the magnets to each other will align the clamping member 224 with the clamping member 210. This provides an added improvement over the prior art, as the magnets provide a means that will assist in properly aligning the upper and lower clamping members. This alignment combined with the alignment of the lower clamping member with a hooping board provides a more efficient process to align the clamping member with respect to a piece of material or garment to be embroidered.

Figure 18:
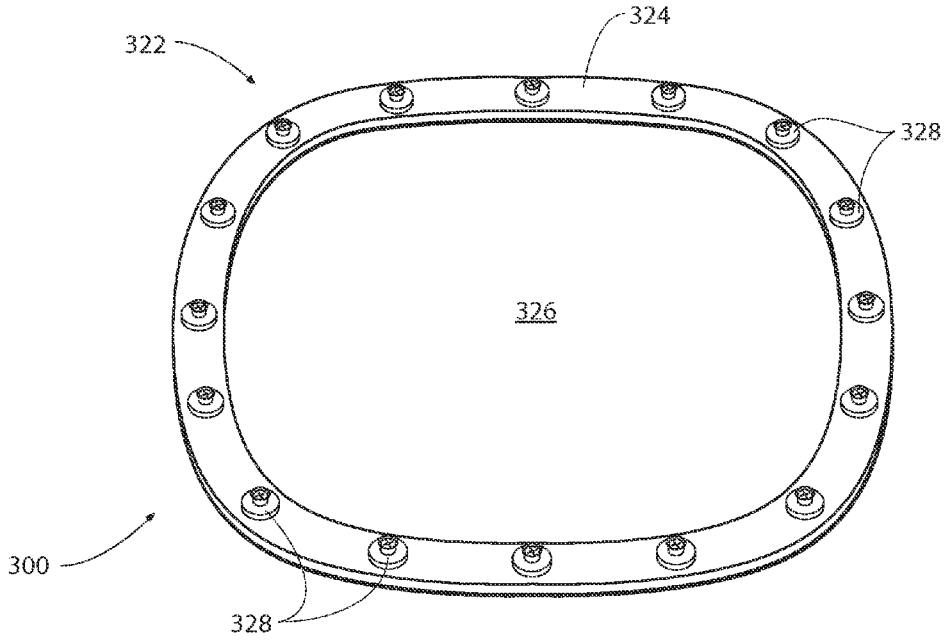
FIG. 18 shows a bottom clamping member arranged to mate with the member of FIG. 17.

FIGS. 17 and 18 show yet another embodiment 300 of a hoop according to the present invention. FIG. 17 depicts a clamping member 310, having a generally quadrilateral-shaped body 312, which forms an opening 314. The body 312 supports a ridge 316 and a pair of arms 320, which can be securely fastened to the body 312. A plurality of magnets 318 is located on the body. The magnets 318 will mate with respective magnets 328 located on a lower clamping member 322, shown in FIG. 18. As with the previous embodiment, the clamping member 322 has a generally quadrilateral-shaped body 324 that defines a hole 326, which is designed to mate with the upper member 310. As FIGS. 17 and 18 demonstrate, the size and shape of the member as well as the number of magnets used can vary from one hoop to another and still fall within the scope of the present invention.

Figure 19:
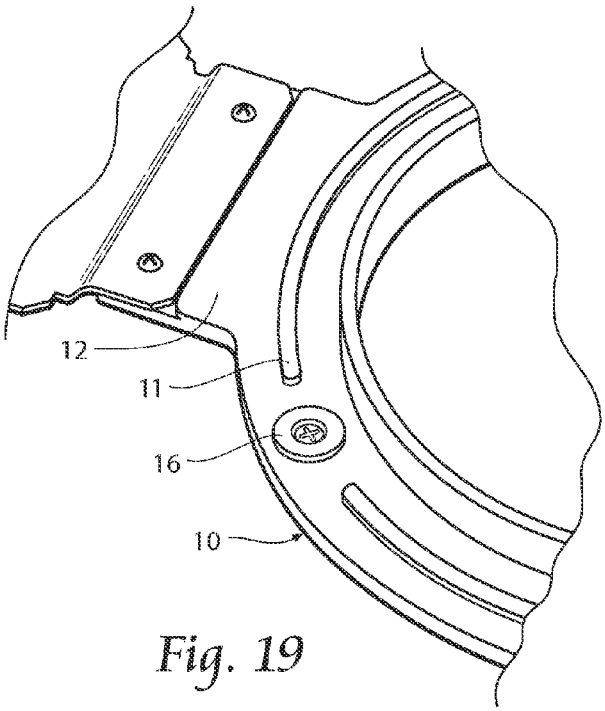
FIGS. 19, 20 and 20A are close-up, partially cut-away views of clamping members according to the present invention, showing a raised section located on the members.
Figure 20:
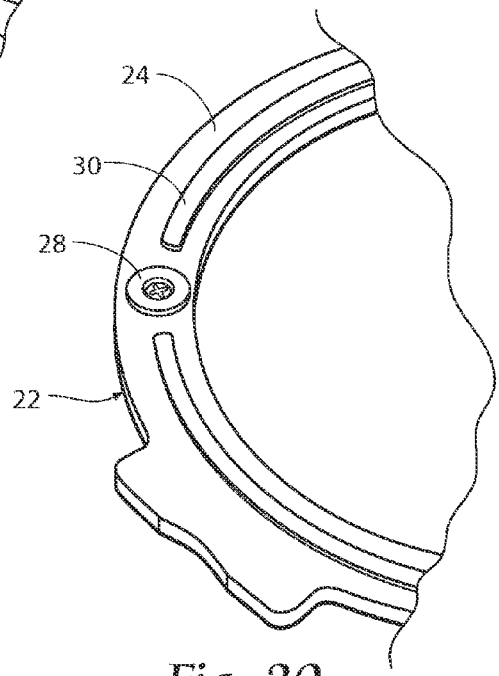
Figure 20A:
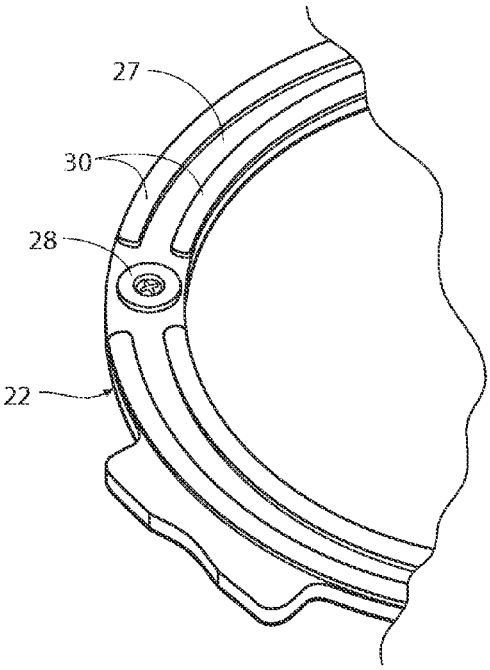

FIGS. 19 and 20 provide close-up views of the clamping members 10 and 22. The body 12 of the upper clamping member 10 further comprises a raised area 11, which is generally raised to the height of the magnets 16, while a raised area 30 located on the lower clamping member 22 is also raised to the height of the magnets 28. This can assist in properly gripping the materials between the clamping members 10 and 22 (FIG. 2) and holding the material taut while the embroidery operation is being performed. FIG. 20A depict the lower member 22 with a pair of raised areas 30. The pair of raised areas 30 shown in FIG. 20A define a recess 27 wide enough for raised area 11 to fit there between. The raised areas 11 and 30 are not always necessary, but are advantageous based on the arrangement of the magnets used in the application. For instance, if the magnets 16 were located inside of the body 12 or on the underside of the body 12, the raised area 11 may not be necessary. Similarly, if the magnets 28 were located inside the body 24 or on the top of the body 24, the raised area 30 may not be necessary.

FIGS. 21 through 24 provide yet another embodiment 500 of a hoop according to the present invention. The hoop 500 comprises an upper clamping member 510 and a lower clamping member 522. The upper clamping member 510 is attached to a pair of oppositely disposed arms 520, as with the previous embodiments. The upper clamping member 510 comprises a ridge 518, with the lower clamping member 522 being arranged to mate with the upper clamping member 510 around the ridge 518. However, the device 500 further comprises added safety features that may be necessitated when more powerful magnets are required to securely retain a garment to be embroidered. The magnets used in the present invention, preferably rare earth magnets, have a significant pull towards one another, which can catch a person off guard. A person may inadvertently get a finger caught between the clamping members 510 and 522 as the magnets are easily attracted towards each other. The clamping members can also attract to one another before the material to be embroidered is properly aligned. The device 500 minimizes any inadvertent attraction of the magnets by providing actuatable biasing means that prevent attraction of the clamping members 510, 522 until urged together by the user. The biasing means generally comprise a secondary ring or support member 530, which is connected to and biased away from upper clamping member 510 by springs 532. Many different types of springs 532 can be used for biasing, including but not limited to, compression springs, torsion springs or leaf springs. Upper clamping member 510 may contain holes 525 for magnets 516 to pass into or through 510 and be attracted to magnets 528 of the lower clamping member 522 when secondary ring 530 is pressed towards the upper clamping member 510.

Figure 21:
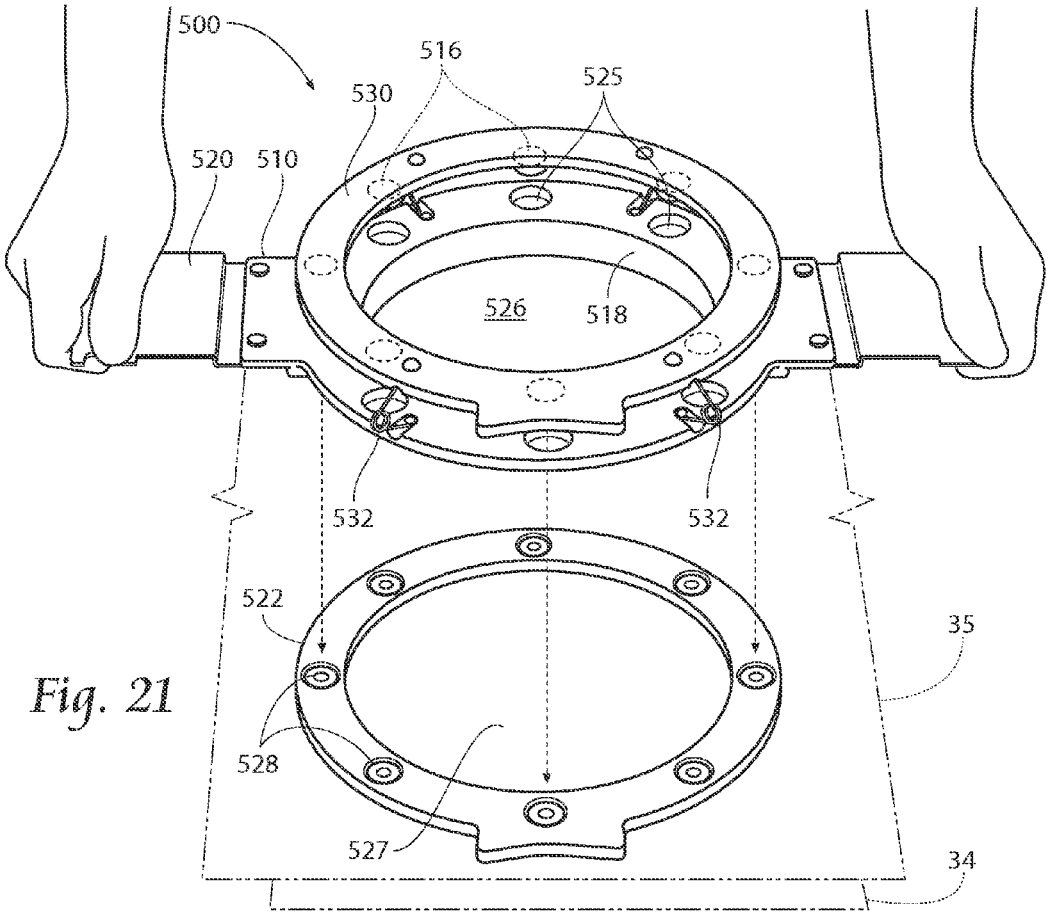
FIG. 21 is an exploded perspective view of still yet another embodiment of the present invention.

In FIG. 21, the embroidery backing material 34 and material to be embroidered 35 is placed upon the lower clamping member 522. Once the material 35 is close to being properly situated, the upper clamping member 510 is placed over the backing material 34, material to be embroidered 35, and clamping member 522. At this point the upper and lower clamping members are not attracted to one another with enough force to hold the material. This allows the user to adjust or reposition the material 35, if necessary, without the magnets 516 and 528 drawing towards one another.

Once the material 35 is properly positioned, the secondary ring 530 of the upper clamping member 510 can be pushed down towards the material to be held 35 and clamping member 522, thereby securely retaining the material 35 and backing material 34 within the hoop 500 as with the previous embodiments.

Figure 22:
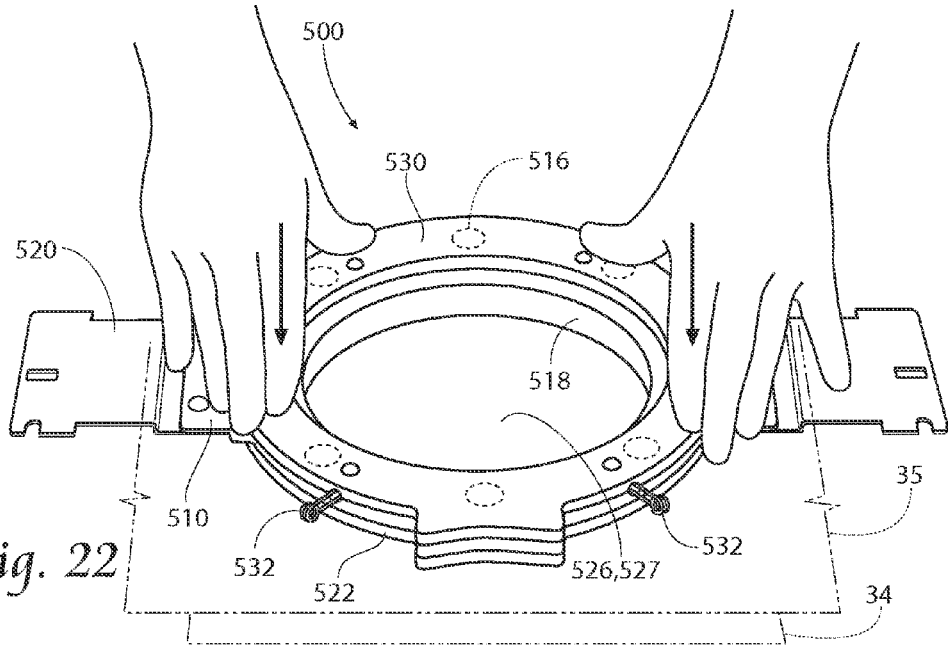
FIG. 22 is another exploded perspective view of the embodiment shown in FIG. 21 after the upper and lower clamping members have mated.

FIG. 22 shows a perspective view of member 510 mating with member 522 and material 35 and 34, after the secondary ring 530 is pressed towards member 510 to overcome the bias of springs 532, magnets 516 and 528 are then attracted to each other holding the material 35 and backing material 34 tightly between the clamping members.

Figure 23:
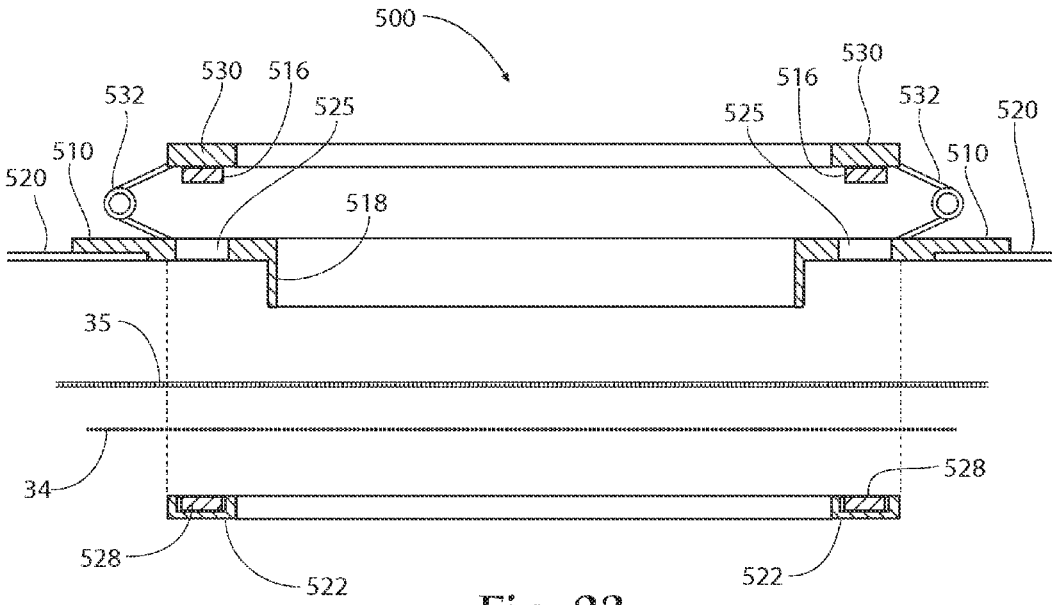
FIG. 23 is a side view of the embodiment of FIG. 21 in a non-engaging position with a piece of material.

FIG. 23 shows a side view of members 510 and 522 when spring bias 532 is not being overcome and member 510 is not being attracted to member 522.

Figure 24:
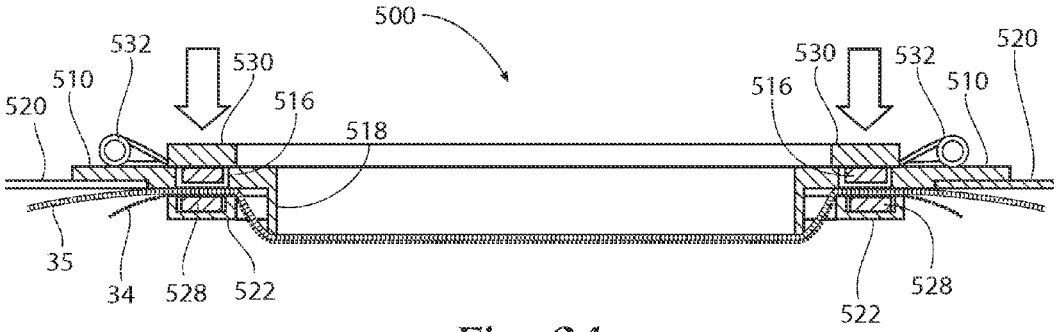
FIG. 24 is a side view of the embodiment of FIG. 21 in an engaged position with a piece of material.

FIG. 24 shows a side view of member 510 mating with member 522 and material 35 and 34, after the secondary ring 530 is pressed towards member 510 to overcome the bias of springs 534, magnets 516 and 528 are then attracted to each other holding the material 35 and backing material 34 tightly between the clamping members.

The present invention provides a hoop used with embroidery machines that is easy to apply to garments and align during the hooping process. As stated previously, the poles of the magnets could be arranged in any pattern as long as the respective magnet on the opposite member had the opposite pole. Likewise, one of the clamping members could support a metal material rather than magnets and still fall within the scope of the present invention. The use of separately attached magnets also has the added benefit of self-aligning the clamping members with one another. Because the magnets are preferably arranged at respective places on both members, the attraction between the magnets will force the members into proper alignment, resulting in less time to properly align the members. If one continuous magnet was used around each of the members, as depicted in the prior art, self aligning would not occur.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A material retaining device for an item to be embroidered by an embroidery machine, the material retaining device comprising:

a first hoop, wherein the first hoop defines a first opening therethrough and the first hoop comprises a plurality of individual spaced apart magnets and a non-magnetic material, the plurality of individual spaced apart magnets attached to the non-magnetic material;

a second hoop, wherein the second hoop defines a second opening therethrough and the second hoop comprises a quantity of metal sufficient for the first hoop to be attracted to the second hoop, wherein magnetic attraction between the first hoop and the second hoop enables the material to be held in place between the first hoop and the second hoop for embroidery, wherein the second hoop is separable from the first hoop at least when the second hoop is magnetically disengaged from the first hoop, and wherein only one of the first hoop and second hoop is adapted to be supported directly by the embroidery machine, and the other of the first hoop and second hoop is held substantially stationary by the magnetic attraction.

2. The device of claim 1, wherein the second hoop comprises both metal and non-metal materials.

3. The device of claim 1, wherein the plurality of individually spaced apart magnets are evenly distributed throughout the first hoop.

4. The device of claim 1, wherein the first opening comprises a same size and shape as the second opening to maintain a scope of embroiderable area provided by the second hoop.

5. The device of claim 1, further comprising:

an adapter coupled to at least one of the first hoop or second hoop, wherein one end of the adapter is coupled to at least one of the first hoop or second hoop and the other end of the adapter is attachable to an attachment mechanism on the embroidery machine, wherein the adapter comprises one or more protrusions and wherein the one or more protrusions on the adapter mate with one or more corresponding indentations on the attachment mechanism to attach the at least one of the first hoop or the second hoop to the embroidery machine.

6. The device of claim 1, wherein the second hoop is non-hingeably engageable to the first hoop.

7. The device of claim 1, wherein the first hoop and the second hoop each has a rectangular shape and a rectangular aperture.

8. The device of claim 1, wherein the first hoop has an inward-facing surface adapted to face the second hoop when the first and second hoops are magnetically engaged, the inward-facing surface of the first hoop approximating a flat surface; and wherein the second hoop has an inward-facing surface adapted to face the first hoop when the first and second hoops are magnetically engaged, the inward-facing surface of the second hoop approximating a flat surface.

9. The device of claim 1, wherein the first hoop is in a non-touching relationship with the second hoop when the second hoop is separated from the first hoop.

10. The device of claim 1, wherein the non-magnetic material comprises plastic.

11. The device of claim 1, wherein one of the first hoop and the second hoop comprises an annular ridge and, when the first hoop and the second hoop are magnetically engaged, the other of the first hoop and the second hoop surrounds the annular ridge.

12. A material retaining device for an item to be embroidered comprising:

a metallic hoop for use in an embroidery machine, wherein the metallic hoop comprises a quantity of metal sufficient for a magnet to be attracted to the metallic hoop, and wherein the material is placeable on the metallic hoop; and a magnetic hoop comprising one or more magnets adapted to magnetically engage the metallic hoop, the magnetic hoop comprising a non-magnetic material and a plurality of individual spaced apart magnets, the plurality of individual spaced apart magnets attached to the non-magnetic material, the material securable between the metallic hoop and the magnetic hoop when the magnetic hoop is magnetically engaged to the metallic hoop, the magnetic hoop disconnectable from the metallic hoop at least when the magnetic hoop is magnetically disengaged from the metallic hoop, wherein only one of the magnetic hoop and the metallic hoop is adapted to be supported directly by the embroidery machine, and the other of the magnetic hoop and the metallic hoop is adapted to be held substantially stationary by the magnetic engagement.

13. The device of claim 12, wherein the magnetic hoop is a positioning template containing a window for positioning the material.

14. The device of claim 12, wherein the magnetic hoop is adapted to be separated from the metallic hoop by the material while the magnetic hoop is magnetically engaged to the metallic hoop.

15. The device of claim 12, wherein one of the magnetic hoop and the metallic hoop comprises an annular ridge and, when the magnetic hoop and the metallic hoop are magnetically engaged, the other of the magnetic hoop and the metallic hoop surrounds the annular ridge.

16. A material retaining device adapted to be coupled to an embroidery machine, the material retaining device comprising:

a first hoop having a substantially rectangular shape and a substantially rectangular aperture, the first hoop comprising both a plurality of individual spaced apart magnets and non-magnetic material, the plurality of individual spaced apart magnets attached to the non-magnetic material;

a second hoop comprising metal and having a substantially rectangular shape and a substantially rectangular aperture, the second hoop adapted to be magnetically engaged to the first hoop to secure a piece of material, the first hoop separable from the second hoop at least when the first hoop is magnetically disengaged from the second hoop such that the first hoop is in a non-touching relationship with the second hoop;

an adapter removably attached to only one of the first or second hoop wherein the adapter is attachable to an attachment mechanism on the embroidery machine, wherein the other of the first hoop and the second hoop is adapted to be held substantially stationary by the magnetic engagement.

17. The device according to claim 16, wherein the first hoop has a substantially square shape and a substantially square aperture, and wherein the second hoop has a substantially square shape and a substantially square aperture.

18. The device of claim 16, wherein one of the first hoop and the second hoop comprises an annular ridge and, when the first hoop and the second hoop are magnetically engaged, the other of the first hoop and the second hoop surrounds the annular ridge.

* * * * *

UNITED STATES PATENT AND TRADEMARK OFFICE

CERTIFICATE OF CORRECTION

PATENT NO. : 8,661,995 B2
APPLICATION NO. : 13/161282
DATED : March 4, 2014
INVENTOR(S) : Mack et al.

It is certified that error appears in the above-identified patent and that said Letters Patent is hereby corrected as shown below:

On the title page item (57) Abstract In line 7 of the abstract, after "alignment of the" delete "hoping" and substitute -- hooping --.

Signed and Sealed this
First Day of July, 2014

Michelle K. Lee

Michelle K. Lee
*Deputy Director of the United States Patent and Trademark Office*